United States Patent [19]

Ruf et al.

[11] Patent Number: 5,076,768

[45] Date of Patent: Dec. 31, 1991

[54] ROTARY PISTON COMPRESSOR

[75] Inventors: Renate Ruf, Romerstrasse 11, D-7107 Neckarsulm; Rudolf Bierling, Schwaigern, both of Fed. Rep. of Germany

[73] Assignee: Renate Ruf, Neckarsulm, Fed. Rep. of Germany

[21] Appl. No.: 466,306

[22] PCT Filed: Sep. 30, 1988

[86] PCT No.: PCT/DE88/00601

§ 371 Date: Mar. 30, 1990

§ 102(e) Date: Mar. 30, 1990

[87] PCT Pub. No.: WO89/02985

PCT Pub. Date: Apr. 6, 1989

[30] Foreign Application Priority Data

Oct. 2, 1987 [DE] Fed. Rep. of Germany ..... 3733398
Dec. 31, 1987 [DE] Fed. Rep. of Germany ..... 3744637

[51] Int. Cl.[5] ..... F04B 19/02
[52] U.S. Cl. ..... 417/462; 418/164
[58] Field of Search ..... 417/462; 418/160, 161, 418/164; 123/44 R, 44 D

[56] References Cited

U.S. PATENT DOCUMENTS

| | | | |
|---|---|---|---|
| 1,887,884 | 11/1932 | Eyston | 418/161 |
| 3,012,550 | 12/1961 | Paschke | 418/166 |
| 3,311,094 | 3/1967 | Kehl | 418/164 |
| 4,723,895 | 2/1988 | Hayase | 417/462 |
| 4,915,596 | 4/1990 | McCall | 417/462 |

*Primary Examiner*—Richard A. Bertsch
*Assistant Examiner*—Michael I. Kocharov
*Attorney, Agent, or Firm*—Kane, Dalsimer, Sullivan, Kurucz, Levy, Eisele and Richard

[57] ABSTRACT

A rotary piston compressor with parallel internal axes has a driven external rotor (12) with a compression chamber (17) in which an internal rotor (20) is rotatably mounted. The internal rotor (20) is hollow, made of light metal, and mounted on a shaft (21). Perfect balancing of the masses of the internal rotor (20) is achieved by having metal pins (42,43) which extend the full length of the internal rotor (20). The heavy metal pin (43) also prevents rotation of the internal rotor (20) about the shaft (21) when these parts are not monolithic.

9 Claims, 3 Drawing Sheets

ROTARY PISTON COMPRESSOR

Figure 1:
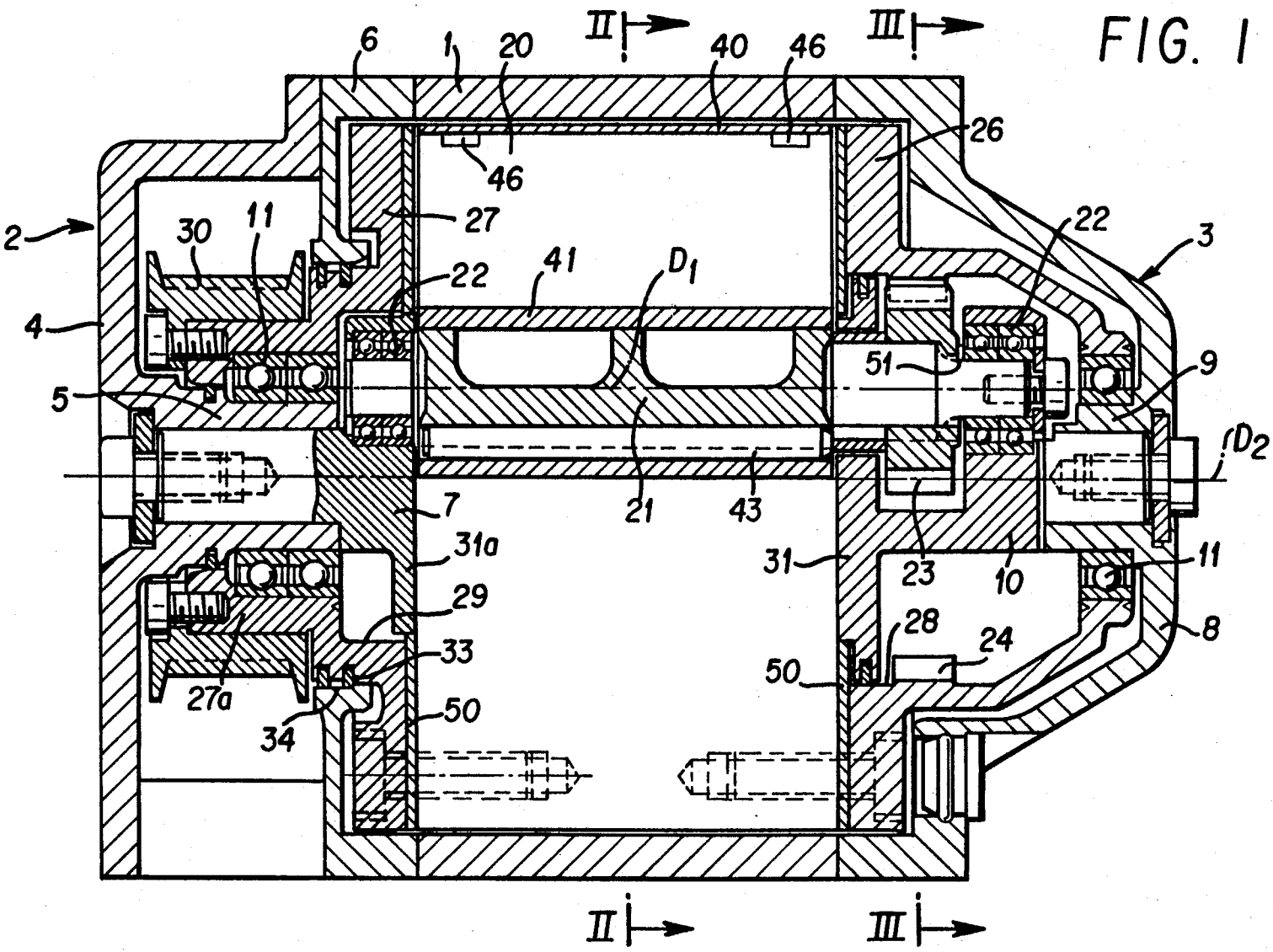

The invention relates to a rotary piston compressor.

In rotary piston compressors of this kind using meshing lobes there is a rotatory speed ratio of $n_1=n_2+1$ between the inner rotor and the otuer rotor, i.e., the inner rotor rotates faster than the outer rotor in a ratio of 2:1, 3:2, 4:3 etc. In a rotary piston machine with the rotatory speed ratio of $n_1:n_2=2:1$, which is especially suitable as a compressor on account of its low harmful capacity, each of the two working chambers performs one suction cycle and one discharge cycle with each full rotation of the outer rotor.

In known rotary piston machines of this kind (U.S. Pat. No. 883,271, European Patent A 0087 748) the shaft of the inner rotor is brought out and fastened to a drive pulley and in turn drives the outer rotor through the gear transmission at a rotatory speed of $n_2=n1/2$. For high output capacities this requires high driving speeds, since for each rotation of the inner rotor only half of the full period is executed.

It is the object of the invention to create a rotary piston compressore which will be characterized by a high output at low driving speeds.

This object is achieved.

In the rotary piston compressor according to the invention, due to the circumstance that it is not the inner rotor but the outer rotor that is driven, with each revolution of the driven shaft the full period is executed in each working chamber, so that the proposed rotary piston compressor, at a rotatory speed ratio of $n_1:n_2=2:1$, produced at a given drive speed twice the pumping volume of a compressor according to the state of the art.

The proposed rotary piston compressor furthermore has important advantages over the state of the art as regards the journaling of the outer rotor. In the known rotary piston machines, in which the inner rotor is driven, the bearings of the outer rotor must have a large diameter, since the shaft of the inner rotor, which is off-center from the axis of rotation of the outer rotor, extends to the exterior. Bearings of great diameter, however, are expensive and at high rotatory speeds they are subjected to heavy stress. To reduce this stress, in the embodiment of the above-mentioned European Patent A 0087 746 the outer rotor is not journaled in a large bearing but on three symmetrically disposed rollers. This solves the problem of the high peripheral speed of the large bearing, but at the cost of a complex design.

In the proposal of the invention, however, the outer rotor with its side walls can be journaled axially outside of the bearings of the inner rotor; the diameter of these bearings can be relatively small since the shaft of the inner rotor terminates axially inside of these bearings.

Because it is the shaft of the outer rotor that is driven in the proposed rotary piston compressor, the shaft of the inner rotor is not subjected to any flexing by the pull of the drive belt. Therefore this compressor is especially suitable for dry running. Dry-running compressors are used when lubricant-free compressed air is needed. No lubricant must enter into the working chambers, and this requires that no seals can be provided which have to be lubricated. Accordingly, such compressors must be manufactured with leak-resistant clearances of the order of 50 to 100 microns. The maintenance of such tight clearances is facilitated in the rotary piston compressor of the invention by keeping the drive stresses away from the inner rotor shaft. The inner rotor is exposed to great centrifugal forces in operation, since it rotates at twice the speed in the 2:1 machine. To combat this stress from centrifugal forces the inner rotor can be made hollow and from light metal, and can be provided with at least one balancing weight of a material of greater specific weight extending substantially over its entire length. Thus a complete balance of masses is achieved in every transverse plane of the inner rotor, so that no bending moments are exerted on the inner rotor or its shaft. The mass balance can be achieved by one or more heavy metal pins, made, for example, from tungsten in a nickel-iron binder, and extending through the inner rotor parallel to the axis of rotation; one of them can be used simultaneously to key the inner rotor on its shaft. Alternatively the shaft can consist of one piece with the balancing weight and can be inserted with a press fit into a corresponding hole in he inner rotor.

It is also important to the maintenance of the tight gap tolerances that the phasing between the inner and outer rotors be established with extreme precision. This phasing is maintained by the gear transmission between the inner and outer rotors. Although in the case of compressors that are not run dry the outer gear can be bolted directly to the inner rotor, this is not possible in dry-running compressors on account of the need for the lubrication of the gears. In order nevertheless to achieve a precise relationship of the pinion to the inner rotor in the case of an external transmission, it is desirable, in the embodiment in which the inner rotor and the shaft are separate parts, to extend the groove containing the heavy metal pin used as the spline beyond the inner rotor at one end, and to dispose the pinion on the shaft outside of the inner chamber of the outer rotor and to couple it for co-rotation with the shaft by means of a key or spline engaging the groove in the shaft. Also, a single key can be provided for securing the inner rotor and the pinion on the shaft for co-rotation therewith.

To permit a complete balancing of the inner rotor, projections pointing radially inward can be created on the inside of the outer circumferential wall of the inner rotor in the area diametrically opposite the hub, and material can be removed from them for the purpose of balancing the rotor. If the ends of the inner rotor are closed with covers so as to prevent lateral flow and minimize leakage, these projections are situated close to the ends and the covers are provided with openings near the projections so that a tool can be passed through them for the removal of material from the projections.

As mentioned above, it is necessary in the case of a dry-running compressor of the generic kind in question to dispose the gear drive between the inner and outer rotors outside of the compression chamber and seal it off from the latter. For this purpose the component of the compressor case, in which the gear end of the shaft is journaled, can have a disk-shaped flange extending between the inner rotor and the pinion, plus a bore through which the shaft can be passed, and it is inserted with its outer circumference sealingly fitted into a matching circular recess in the adjacent end wall of the outer rotor.

As it has been stated above, very close tolerances are normally needed for the maintenance of tight clearances, and these call for high precision of manufacture and correspondingly high costs. To be able to permit greater manufacturing tolerances or to be able to equalize excessively great plus tolerances, the invention also proposes that the two case parts in which the ends of the shaft are journaled and which extend through the end walls of the outer rotor be provided with disk-shaped flanges which are inserted into corresponding circular recesses in the end walls of the outer rotor, and plates of such thickness are provided on the inner end walls of the outer rotor that their inside surfaces are aligned with the inner surfaes of the disk-shaped flanges. By selecting plates of appropriate thickness nay inaccuracy in this regard can be compensated. To compensate axial inaccuracies in regard to the position of the inner rotor relative to the outer rotor, a spacing washer of suitable thickness can be provided between one of the case components and an end of the shaft.

Figure 2:
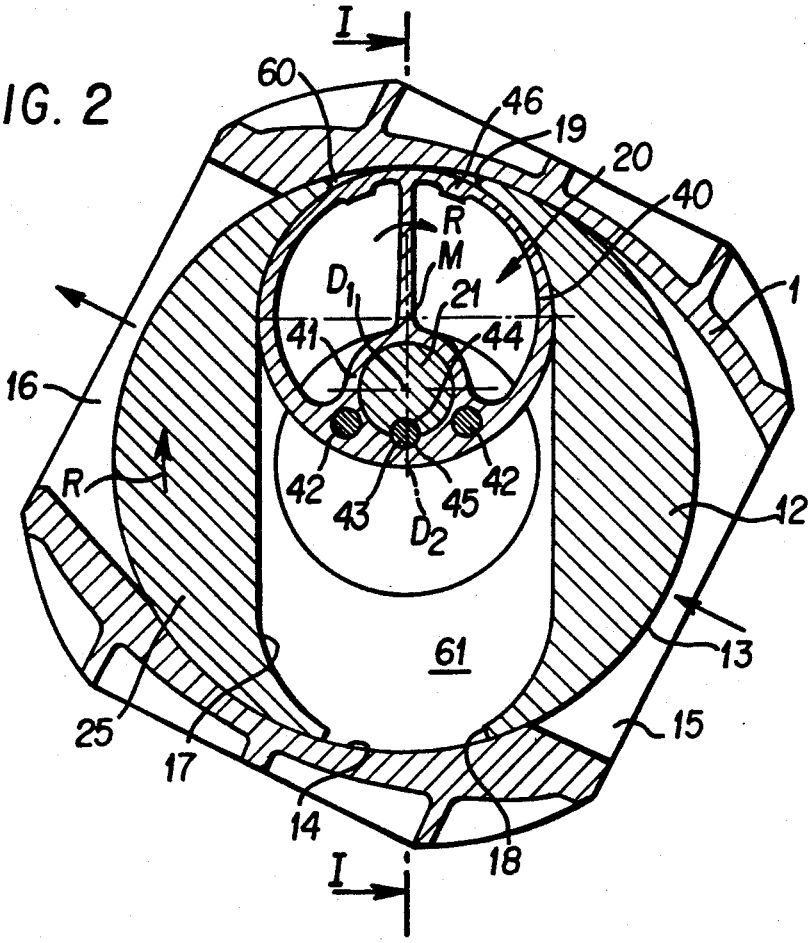
Figure 3:
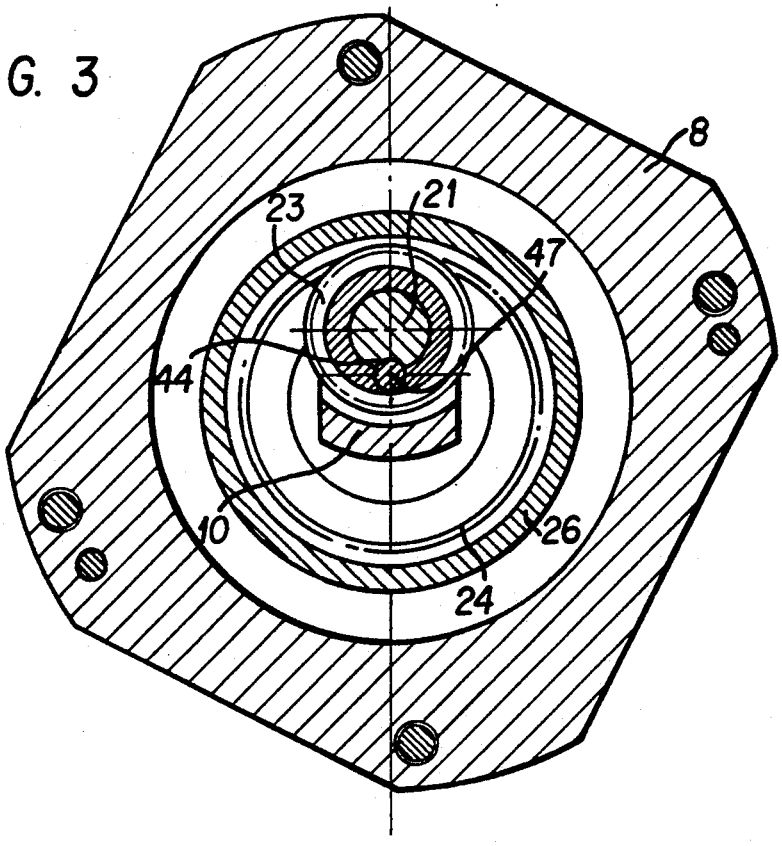
Figure 4:
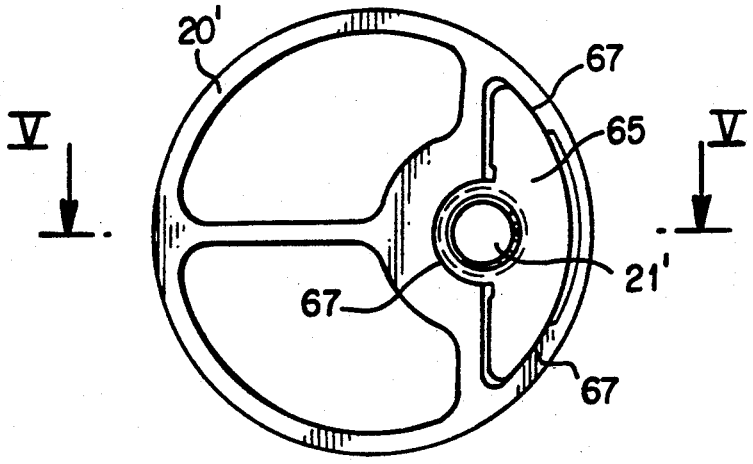
Figure 5:
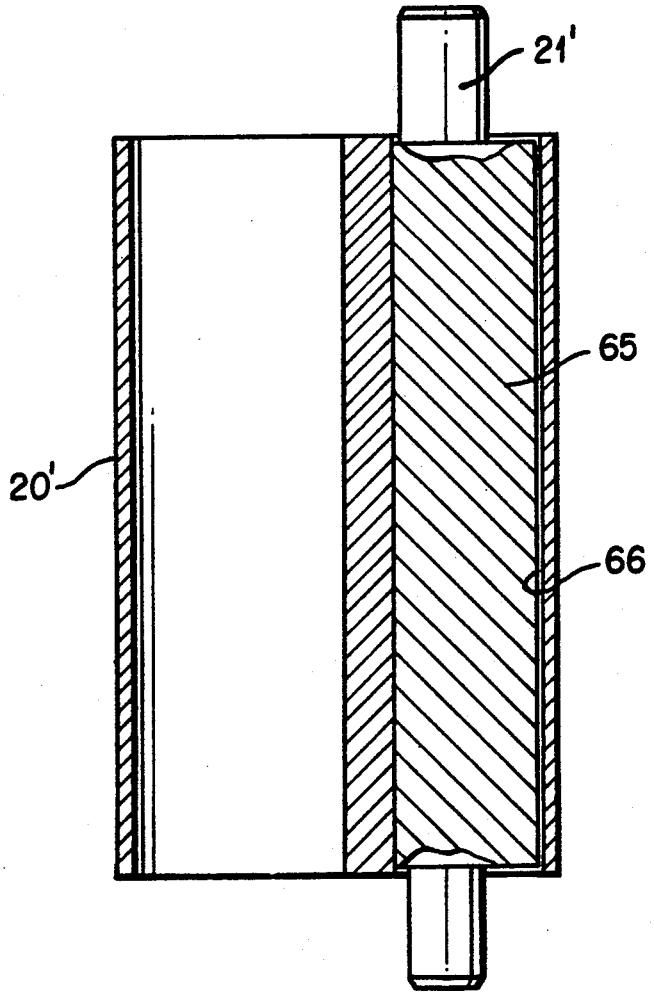

An embodiment of the invention will be described hereinafter with reference to the drawings, wherein:

FIG. 1 is a longitudinal section through a rotary piston compressor, taken along line I—I in FIG. 2, FIG. 2 is a section along line II—II in FIG. 1, FIG. 3 is a section along line III—III in FIG. 1, FIG. 4 is an end view of the inner rotor in a variant, and FIG. 5 is a section along line V—V in FIG. 4.

The parallel-internal axis rotary piston compressor has a case which is composed of a circumferential wall 1 and side members 2 and 3, the left side member having a bearing cover 4 containing a hub 5, a mid-plate 6 and a bearing extension 7 passing through the hub 5, while the right side member 3 consists only of a bearing cover 8 with a hub 9 and a bearing extension 10 passing through the latter.

Inside of the case an outer rotor 12 is journaled on the bearing hubs 5 and 8 on maintenance-free and sealed ball bearings 11; it has a cylindrical outer surface 13 and rotates in the matching cylindrical inner chamber 14 of the case with a narrow sealing clearance, as can be seen in FIG. 2. The inner chamber 14 is in communication with an inlet passage 15 and an outlet passage 16.

In the outer rotor 12 there is provided a compression chamber 17 in the shape of a racetrack oval, which is in communication with the control ports 18 and 19 in the circumferential surface of the outer rotor. In the compression chamber 17 an inner rotor 20 of circular cross section is disposed excentrically on a shaft 21. The diameter of the inner rotor 20 corresponds to the diameter of the semicircular end sections of the compressor chamber 17 except for narrow sealing clearances of the oder of 50 to 100 microns. The inner rotor shaft 21 is, as shown in FIG. 1, journaled on bearings 22 in the bearing extensions 7 and 10, respectively. The axis of rotation D1 of the inner rotor shaft 21 is parallel to the axis of rotation D2 of the outer rotor 12. The inner and outer rotors are in a certain rotational speed ratio to one another, which amounts in this embodiment to 2:1, and is produced by a transmission consisting of a pinion 23 disposed on the inner rotor shaft 21 and an internal gear 24 fastened to the outer rotor 12.

The outer rotor 12 is composed of a central part 25 and lateral walls 26 and 27 which are provided with circular openings 28 and 29, respectively, into which the bearing extensions 7 and 10 extend. A drive belt pulley 30 is connected with the left lateral wall 27 of the outer rotor 12.

To prevent lubricant required for the lubrication of the transmission 23, 24, from getting into the compression chamber 17, the bearing extension 10 is provided with a flange 31 which is inserted sealingly, by means of a sealing ring 32, into the opening 28 in the outer rotor's lateral wall 26. On the opposite side the outer rotor's lateral wall 27 is inserted sealingly, by means of seals 33, into a corresponding circular opening 34 in the midplate 6 of the case.

To be able to achieve very close clearnaces between the inner and outer rotors, an effort must be made to reduce the flexing of the inner rotor shaft 21 to a minimu. One way to achieve this is by designing the rotary piston compressor such that the otuer rotor 12 is driven, so that the inner rotor shaft 21 can be kept short. Another is to make the inner rotor as light as possible. To this end it is hollow and made of light metal, and consists of an outer circumferential wall 40 and a hub 41 through which the shaft 21 passes. To achieve a complete equalization of masses and thus to prevent the shaft 21 from flexing due to centrifugal forces, in the embodiment represented in FIGS. 1 to 3, heavy metal pins 42 and 43 are provided in the inner rotor on the side of the longitudinal central axis M of the inner rotor on which the axis of rotation D1 of shaft 21 is situated, and they extend over the entire length of the inner rotor 20. The heavy metal pins consist of a material of great specific weight, for example tungsten in a nickel-iron binder. In this manner a complete balancing of masses is achieved in the inner rotor 20 in every plane perpendicular to its longitudinal central axis M. The heavy metal pin 43 serves simultaneously for coupling the inner rotor 20 to the shaft 21 for co-rotation therewith, and to accommodate it, grooves 44 and 45 of semicircular cross section are provided in the hub 41 and in the shaft 21. The groove 44 extends rightward in FIG. 1 beyond the inner rotor 20 and serves simultaneously for the correct positioning and coupling of the pinion 23, whose spline 47 (FIG. 3) is engaged in the groove 44. Alternatively, the pin 43 could be lengthened rightward in FIG. 1 and could produce the coupling between the shaft 21 and the pinion 23.

In order to achieve the desired complete balance of masses in the inner rotor 20 a possibility for balancing is provided. For this purpose projections 46 pointing radially inward are provided on the inside of the outer circumferential wall 40 of the inner rotor 20 in the area diametrically opposite the hub 41. The inner rotor 20 can be completely balanced by removing material from the projections 40. If the end faces of the inner rotor 20 are closed by covers, openings are provided in these covers through which the projections 46 can be worked on.

Tight clearances normally call for close tolerances which necessitate high cost of production. To reduce this expense, flat rings 50 are provided on the inside surfaces of the side walls 26 and 27 of the outer rotor, and their thickness is selected such that, after assembly their inside surfaces are flush with the inside surfaces of the flanges 31 and 31*a*. The inside diameter of flat ring on the right in FIG. 1 is smaller than the diameter of the opening 28, so that lubricant escaping over the sealing ring 32 will be unable to enter the compression chamber 17. The axial positioning of the inner rotor 20 relative to the outer rotor 12 is achieved by a spacer 51 between the bearing 22 of shaft 21 and the pinion 23.

The manner of operation of the rotary piston compressor represented is knonw. When the rotors 12 and 20 rotate in the direction of the arrows R in FIG. 2, the compression chamber 17 is divided by the inner rotor 20 into two variable-volume chambers 60 and 61 which are alternately connected by the ports 18 and 19 to the inlet passage 15 and the outlet passage 16.

Of course, many variations of the embodiment shown are possible, without going outside the scope of the invention. One especially useful and obvious variation consists in making the inner rotor 20 and the shaft 21 in one piece from light metal, so that the heavy metal pin 43 contributes only to mass equalization. The number, form and arrangement of the heavy metal pins 42 and 43 will depend on the circumstances.

In FIGS. 4 and 5 an inner rotor 20' is shown whose shaft 21' is integral with a balancing weight 65 and consists, for exmaple, of precision cast steel. This steel part is inserted with a press fit into a cavity 66 and is fitted to areas 67 of the cavity. The balancing weight 65 extends, as can be seen in FIG. 5, through the entire length of the inner rotor 20', so that, as in the case of the inner rotor 20 of FIG. 1, a complete mass balance in every transverse plane of the inner rotor is the result.

We claim:

1. An internal parallel-axis rotary piston compressor with meshing engagement, comprising:

a. a case which has a circumferential wall and side walls with first and second bearing extensions extending axially inwardly;

b. an outer rotor having side walls journaled in the case in bearings on said first bearing extensions, one side wall having an outwardly extending hub surrounding the adjacent bearing extension and bearing a drive pulley, said outer rotor having an inner chamber defined by said side walls;

c. an inner rotor disposed within said inner chamber and defining with a wall of said inner chamber variable-volume working chambers and fastened eccentrically on a shaft disposed parallel to the axis of rotation of the outer rotor and journaled in bearings in said second bearing extensions axially inwardly of the bearings of the outer rotor; and d. a gearing determining a specific rotary speed ratio and the phasing between the inner and outer rotors and consisting of an internal gear fastened to the outer rotor and a pinion meshing therewith and fixed on the inner rotor shaft, said gearing being disposed axially outside of a disk-shaped flange of one of said second bearing extensions through which the inner rotor shaft passes, said flange being inserted with its outer circumference sealingly within a circular recess in the adjacent side wall of the outer rotor.

2. The rotary piston compressor of claim 1, characterized in that the said side wall of the outer rotor is provided on its inner surface with a flat ring whose outer surface is flush with the surface of the flange facing the inner chamber of the outer rotor, and that the inner diameter of said ring is smaller than the diameter of the circular recess in the side wall.

3. The rotary compressor of claim 1, characterized in that the internal gear is attached to said one side wall and the hub with the drive pulley is attached to the other side wall of the outer rotor.

4. The rotary compressor of claim 3, characterized in that an intermediate wall of the case is disposed between the drive pulley and said other side wall of the outer rotor with the hub passing through and sealed against said intermediate wall.

5. An internal parallel-axis rotary piston compressor with meshing engagement, comprising:

a. a case which has a circumferential wall and side walls with first and second bearing extensions and extending axially inwardly;

b. an outer rotor having side walls journaled in the case in bearings on said first bearing extensions, one side wall having an outwardly extending hub surrounding the adjacent bearing extension and bearing a drivel pulley, said outer rotor having an inner chamber defined by said side walls;

c. an inner rotor disposed within said inner chamber and defining with a wall of said inner chamber variable-volume working chambers and fastened eccentrically on a shaft disposed parallel to the axis of rotation of the outer rotor and journaled in bearings in said second bearing extensions axially inwardly of the bearings of the outer rotor; and d. a gearing determining a specific rotary speed ratio and the phasing between the inner and outer rotors and consisting of an internal gear fastened to the ouer rotor and a pinion meshing therewith and fixed on the inner rotor shaft, said gearing being disposed axially outside of a disk-shaped flange of one of said second bearing extensions through which the inner rotor shaft passes, said flange being inserted with its outer circumference sealingly within a circular recess in the adjacent side wall of the outer rotor, wherein said inner rotor is hollow and made of light metal and contains at least one mass balancing weight extending substantially over its entire length and consisting of a material having a greater specific weight than the material of the inner rotor.

6. The rotary piston compressor of claim 5, characterized in that one mass balancing weight is a heavy metal pin which joins the inner rotor for co-rotation with its shaft.

7. The rotary piston compressor of cliam 6, characterized in that the heavy metal pin extends at one end beyond the inner rotor and fastens the pinion to the inner rotor shaft for corotation therewith.

8. The rotary compressof of claim 5, characterized in that the mass balancing weight is integral with the inner rotor shaft.

9. The rotary compressor of claim 5, characterized in that the inner rotor has an outer circumferential wall which is provided in the area diametrically opposite the mass balancing weight with radially inwardly directed projections.

* * * * *